US005562583A

United States Patent [19]

Christensen

[11] Patent Number: 5,562,583

[45] Date of Patent: Oct. 8, 1996

[54] TUBE ADAPTER FOR CENTRIFUGE SHELL TYPE ROTOR

[75] Inventor: Dave S. Christensen, Sandy Hook, Conn.

[73] Assignee: E. I. Du Pont de Nemours and Company, Wilmington, Del.

[21] Appl. No.: 524,683

[22] Filed: Sep. 7, 1995

[51] Int. Cl.[6] ..... B04B 5/02

[52] U.S. Cl. ..... 494/16

[58] Field of Search ..... 494/12, 16, 20, 494/33, 85

[56] References Cited

U.S. PATENT DOCUMENTS

| | | | |
|---|---|---|---|
| 4,226,669 | 10/1980 | Vilardi | 494/12 X |
| 4,449,965 | 5/1984 | Strain | 494/16 |
| 4,484,906 | 11/1984 | Strain | 494/16 |
| 4,820,257 | 4/1989 | Ishimaru | 494/16 |
| 4,832,679 | 5/1989 | Bader | 494/16 |
| 5,362,300 | 11/1994 | Christensen | 494/16 |

FOREIGN PATENT DOCUMENTS

| | | | |
|---|---|---|---|
| 2098516 | 11/1982 | United Kingdom | 494/16 |

*Primary Examiner*—Charles E. Cooley

[57] ABSTRACT

A shell-type centrifuge rotor has a sample container support sleeve extending through the cavity in a plate. The sleeve has at least two slots which define at least one resilient flange pivotally deflectable about a pivot axis to hold the sleeve in a fixed relationship with respect to the plate. In one embodiment both slots extend axially along the sleeve. In an alternate embodiment a first one of the slots extends axially along the sleeve and the second one of the slots extends circumferentially along the sleeve. In a modification to the alternate embodiment a second circumferential slot is formed in the sleeve in generally parallel relationship to the first circumferentially extending slot.

6 Claims, 9 Drawing Sheets

TUBE ADAPTER FOR CENTRIFUGE SHELL TYPE ROTOR

BACKGROUND OF THE INVENTION

1. Field of Invention

The present invention relates to a tube adapter for a shell-type centrifuge rotor.

2. Description of Prior Art

So-called shell-type rotors are well-known in centrifuge art. U.S. Pat. No. 5,362,300 (Christensen), assigned to the assignee of the present invention, is an example of such a rotor construction.

In the typical instance a shell-type rotor includes a generally planar body member onto which an upper plate is attached. The upper plate has an array of cavities each sized to accept a sample container therein. A shell-type rotor has the capacity to hold a relatively large number of sample containers. In a typical instance a rotor may have on the order of twenty-four cavities. Owing to its relatively low cost of manufacture a shell-type rotor is a popular rotor choice when a clinician is presented with the task of spinning a large number of relatively small sized samples (each on the order of two milliliters).

When received in a cavity in the plate each container projects into an open space defined between the between the upper surface of the body member and the undersurface of the plate. The sample container receives no support other than that given by the top surface of the plate. Such a level of support is usually sufficient when the rotor is used for protocols that remain in the low speed regime (i.e., less than eleven thousand rpm.)

However, a shell-type rotor may also be used for protocols that extend into the superspeed regime, where rotational speeds on the order of fifteen thousand rpm are not unusual. When used at a speed in the superspeed regime it may be necessary to provide some form of support for the sample container. In the rotor disclosed in U.S. Pat. No. 4,832,679 (Bader) an adapter, or sleeve, is inserted into the cavities in the plate to provide support for sample containers.

Since a tight fit is required between a support sleeve and a sample container in order for the sleeve to provide the necessary support to the container the sleeve may tend to be extracted from the rotor when the tube is removed from the cavity. Due to the high volume (in terms of number) of sample containers that a clinician processes it is considered an inconvenience for the clinician to have to handle the support sleeves in addition to the sample containers in the event the sleeve becomes removed from the rotor with the extraction of the container.

It is therefore believed advantageous to provide a shell-type centrifuge rotor having a container support sleeve wherein the support sleeve is axially fixed with respect to the rotor so that the sleeve remains with the rotor when the sample container which it is supporting is removed from the rotor.

SUMMARY OF INVENTION

The present invention is directed to a shell-type centrifuge rotor having a plate with an upper surface and an undersurface thereon. The rotor has at least one sample container-receiving cavity extending through the predetermined thickness dimension of the plate. A generally hollow, elongated sleeve having at least one open end with a lip extending circumferentially about the open end of the sleeve is received within the cavity to define a receptacle in which a sample container is received and supported during centrifugation. When received in the cavity the lip abuts against the upper surface of the plate. The sleeve has a basic outside dimension.

In accordance with the present invention the sleeve has at least two slots formed therein. The slots cooperate to define on the sleeve at least one resilient flange having an end thereon. The flange is pivotally deflectable about a pivot axis from an open position in which the end of the flange lies outside the basic outside dimension of the sleeve to a second, holding, position in which the flange abuts against the plate in the vicinity of the cavity therethrough. When in the second position the flange frictionally engages the plate to hold the sleeve in a fixed relationship with respect thereto.

In one embodiment of the present invention both of the slots extend axially along the sleeve from the open end thereof in parallel relationship to each other and to the axis of the sleeve. In this instance the pivot axis of the flange extends circumferentially in a plane that is generally perpendicular to the axis of the sleeve.

In an alternate embodiment of the present invention a first one of the slots extends axially along the sleeve from the open end thereof and the second one of the slots extends circumferentially along the sleeve. The first and the second slots intersect each other to define a pair of resilient flanges, the pair of flanges including said at least one resilient flange. In this instance the pivot axis of each flange extends generally parallel to the axis of the sleeve. Each flange in the pair of flanges is pivotally deflectable about its pivot axis from an open position in which the end of the flange lies outside the basic outside dimension of the sleeve to a second, holding, position in which the flange abuts against the plate in the vicinity of the cavity therethrough.

The alternate embodiment of the invention may be modified to further comprise a second circumferentially extending slot formed in the sleeve in generally parallel relationship to the first circumferentially extending slot. The second circumferentially extending slot is spaced from the open end of the sleeve a distance greater than the distance at which the first circumferential slot is spaced from the open end of the sleeve. The second circumferential slot cooperates with the axial slot and with the first circumferential slot to define a second pair of resilient flanges, with each of the flanges in the second pair being pivotally deflectable about a pivot axis from an open position (in which the end of the flange lies outside the basic dimension of the sleeve) to a second, retracted, position. The pivot axis of each flange extends generally parallel to the axis of the sleeve. While in the open position the each flange in the second pair abuts against the undersurface of the plate to prevent axial movement of the sleeve with respect to the plate.

In either aspect of the alternate embodiment of the invention the first circumferential slot is disposed a distance from the open end of the sleeve that is at least equal to the thickness dimension of the plate.

BRIEF DESCRIPTION OF DRAWINGS

The invention will be more fully understood from the following detailed description, taken in connection with the accompanying drawings, in which.

DETAILED DESCRIPTION OF THE INVENTION

Figure 1:
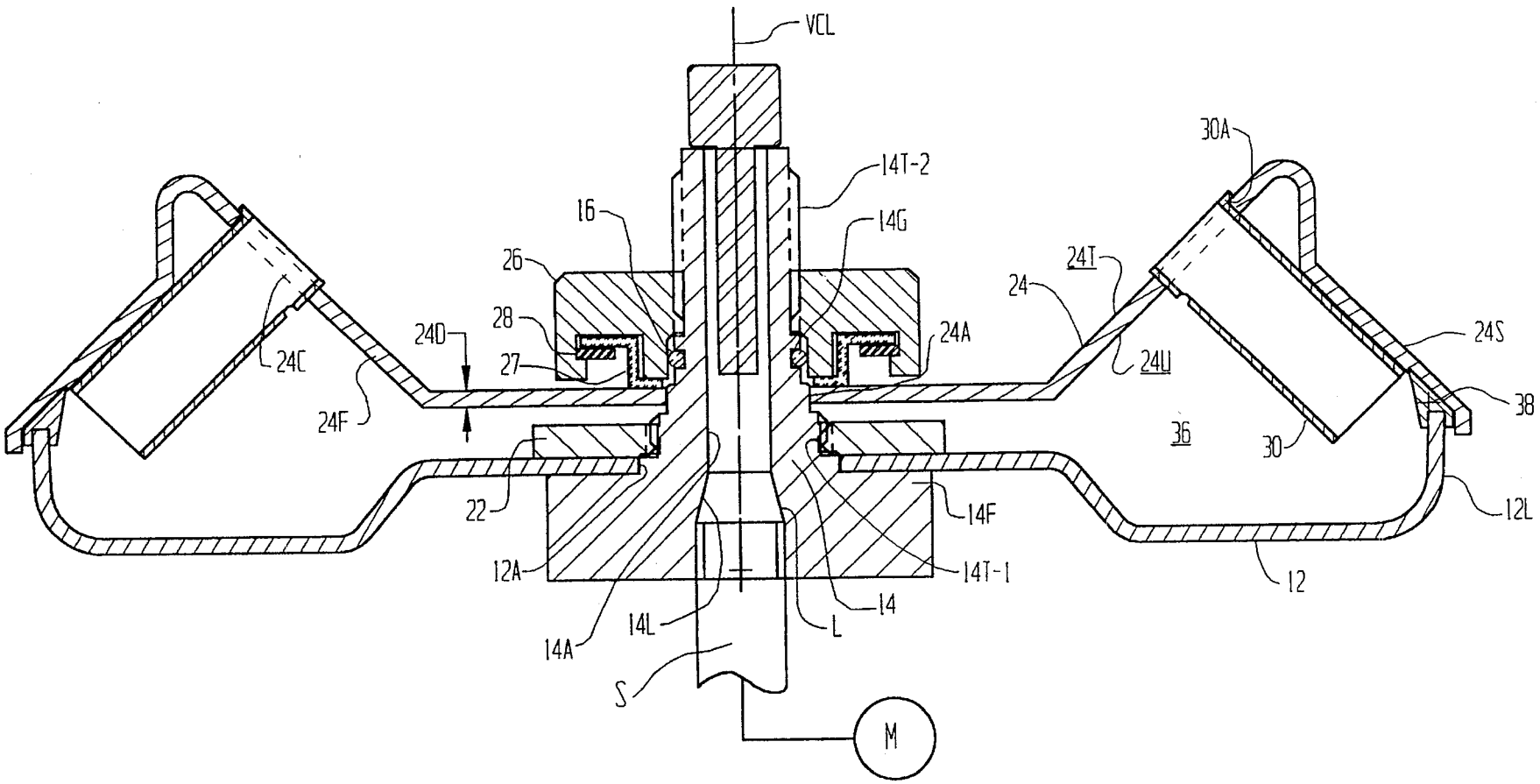
FIG. 1 is a side elevational view, substantially entirely in section, of a shell-type centrifuge rotor in accordance with the present invention.

Throughout the following detailed description similar reference characters refer to similar elements in all Figures of the drawings.

FIG. 1 shows a shell-type centrifuge rotor generally indicated by the reference character 10 in accordance with the present invention. The rotor is shown as mounted to the upper end of a drive shaft S (FIG. 1). The shaft S is connected to a motive source M. The shaft S has an axis of rotation VCL extending vertically and axially therethrough. The rotor 10 rotates about the axis of rotation VCL.

The rotor 10 includes a body member 12 having a central opening 12A therein. The radially outer extent of the body 12 is upturned to define a lip 12L. The body 12 is fabricated from any suitable material, such as aluminum, as by stamping. A drive adapter 14 (FIG. 1) extends centrally and axially through the opening 12A in the body 12. The drive adapter 14 itself has a central axial opening 14A extending therethrough, with the lower portion of the opening 14A being provided in the form of a frustoconical locking taper 14L. The locking taper 14L is configured to receive a similarly configured locking surface L formed on the shaft S. The drive adapter 14 has a radially enlarged flange portion 14F thereon. The upper surface of the flange 14 F defines a shelf which accepts and supports the central portion of the body 12. Both the middle and upper portions of the outer surface of the adapter 14 are threaded, as at 14T-1, 14T-2, respectively. A groove 14G extends about the adapter 14 at a location thereon axially between the threaded portions 14T-1, 14T-2. An O-ring 16 is provided within the groove 14G for a purpose to be described.

A spacer nut 22 is threaded on the adapter 14 on the first threaded portion 14T-1. The spacer nut 22 serves to attach the body member 12 to the adapter 14.

The upper plate 24 is received on the adapter 14. The plate 24 an opening 24A therein. The opening 24A in the plate 24 is closely received on the drive adapter 14 so that the plate 24 does not shift during operation. The plate 24 is bent to define a generally frustoconical portion 24F. The frustoconical portion 24F is interrupted by an array of cavities, or sample container-receiving openings, 24C. Each cavity 24C is sized to receive a sleeve 30. The radially outer extent of the frustoconical skirt 24S vertically overlies the lip 12L of the body 12.

The upper plate 24 has an upper surface 24T and a undersurface 24U. The thickness dimension of the plate 24 is indicated by the reference character 24D. The undersurface 24U of plate 24 has a groove formed in the region of 24S. Details of this groove in the plate 24 and a seal member 38 are set forth in U.S. Pat. No. 5,362,300 (Christensen), assigned to the assignee of the present invention. The plate 24 is fabricated from a material such as aluminum.

The plate 24 is secured to the adapter 14 by a hold-down knob 26. Details on the hold-down knob 26, O-ring 16, washer 27 and snap ring 28 can also be found in the above-mentioned U.S. Pat. No. 5,362,300 (Christensen), which patent is hereby incorporated by reference herein.

As is seen from FIG. 1 an open volume 36 is defined between the plate 24 and the body 12. The sleeve 30 is received in each cavity 24C in the plate 24. The sleeve 30 is supported by the abutment of the circumferential lip 30A against the upper surface 24T of the plate 24, while the major portion of the length of the sleeve 30 is received within the volume 36.

Figure 2B:
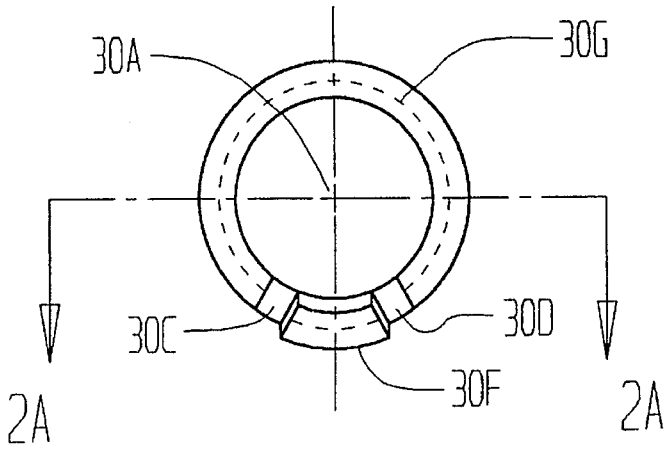
FIG. 2B is a plan view of the sleeve shown in FIG. 2A.
Figure 2A:
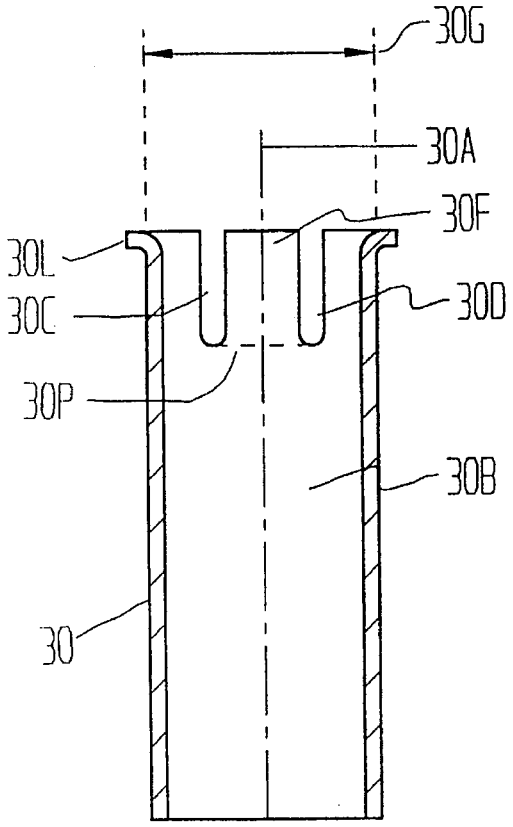
FIG. 2A is a side elevational view, substantially entirely in section, of a sleeve arranged for use in a shell-type rotor in accordance with a first embodiment of the present invention.
Figure 2C:
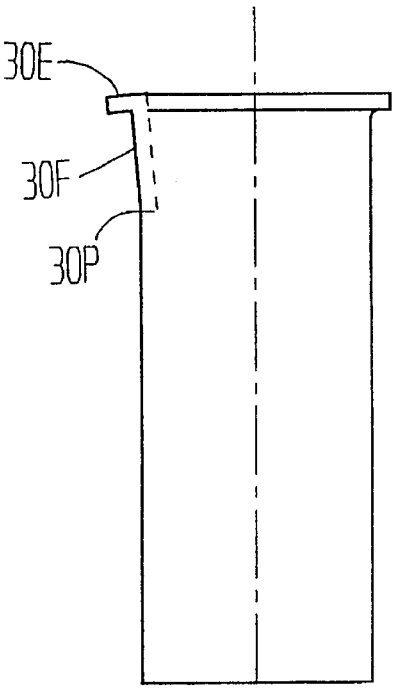
FIG. 2G is a side view of the sleeve shown in FIG. 2A.
FIG. 2D is an enlarged side elevational view illustrating the sleeve shown in FIG. 2A received into the rotor plate of the shell-type rotor.
Figure 2D:
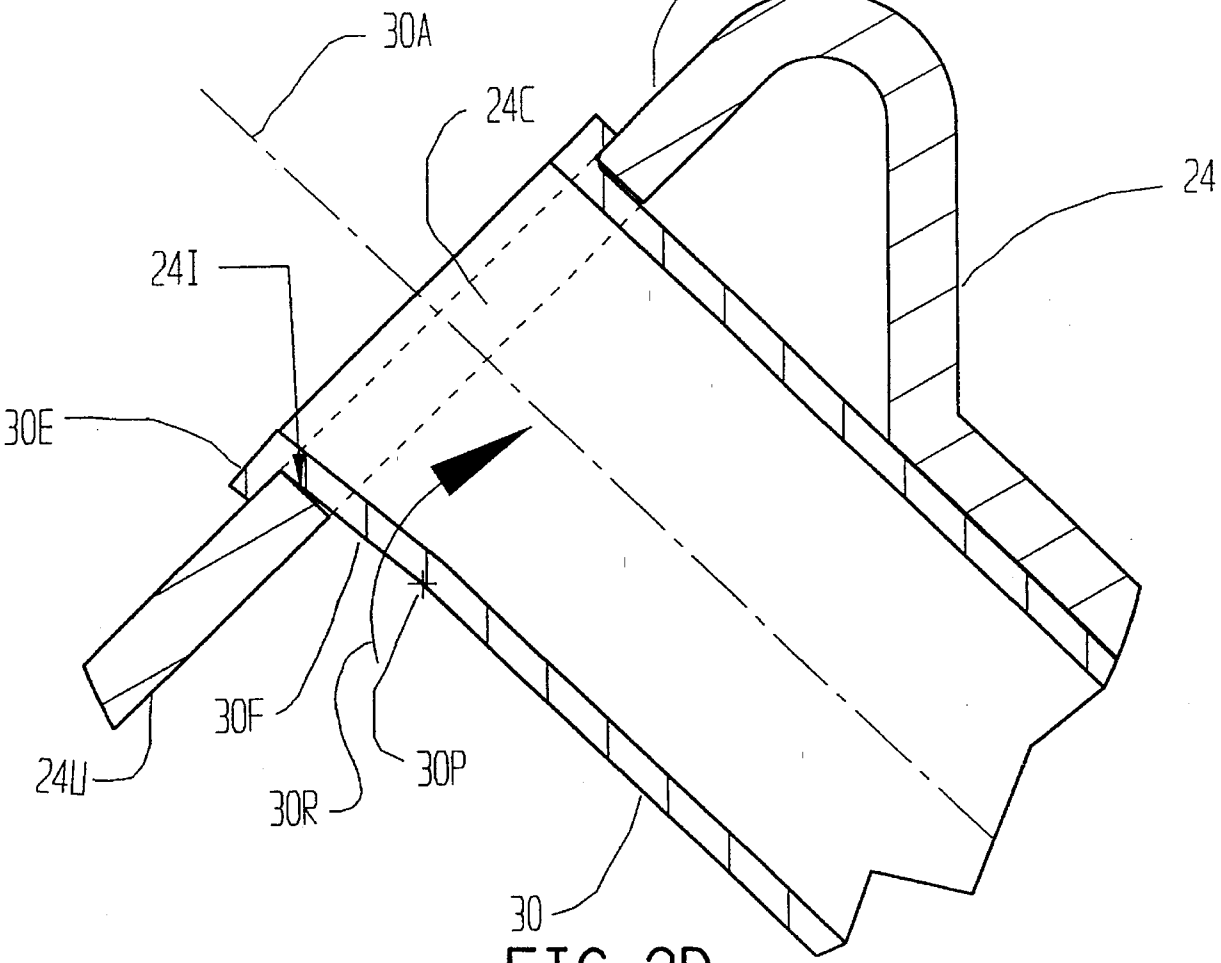

In accordance with a first embodiment of the invention the rotor 10 uses a sleeve 30 as shown in FIGS. 2A, 2B and 2C in the cavities 24C of the plate 24. The sleeve 30 has a circumferential lip 30L and a hollow inner bore 30B. The lower end of the sleeve may be closed, if desired, so long as a hollow cavity sized to receive a sample container is defined. An axis 30A extends centrally through the sleeve 30. In addition the sleeve 30 has two axially extended slots 30C and 30D which form a flange 30F. Both of the slots 30C and 30D extend in parallel relationship to each other from the open upper end of the sleeve 30. The slots 30C and 30D are generally parallel to the axis 30A of the sleeve 30. The flange 30F is pivotally deflectable about a pivot axis 30P from a first, open, position (FIGS. 2A–2C) to a second, holding, position (FIG. 2D). The pivot axis 30P of the flange 30F extends circumferentially in a plane that is generally perpendicular to the axis 30A of the sleeve 30 (i.e., a plane parallel to the plane of FIG. 2B).

In the first, open, position (FIG. 2C) the end 30E of the flange 30F lies outside the basic outside dimension 30G of the sleeve 30. In the second, holding, position (FIG. 2D) the flange 30F abuts against the plate 24 in the vicinity of the cavity 24C therethrough.

Since the cavity 24C in plate 24 is sized to receive closely the basic diameter 30G, and since the flange 30F lies outside the basic diameter 30G, the flange 30F must be retracted (moved from the open position toward the second position) as the sleeve 30 is slidably inserted into the cavity 24C in plate 24. The insertion of the sleeve 30 into the cavity 24C causes the flange 30E to pivot about the axis 30P in a plane perpendicular to the axis 30A of the sleeve 30, as suggested by the arrow 30R, FIG. 2D). After the sleeve 30 is axially inserted into the cavity 24C in plate 24 the resiliency of the flange 30F urges the same radially outwardly (relative to its axis 30A) to exert pressure against the plate 24 in the vicinity of the cavity 24C. The pressure exerted by the flange 30F causes the sleeve 30 to frictionally engage the plate 24 along a holding interface 24I in the vicinity of the cavity 24C. This action holds the sleeve 30 in an axially fixed relationship with respect to the plate 24. As used throughout this application the term "axially fixed relationship" is meant to denote that the sleeve (however configured in accordance with the teachings hereof) is not movable from the plate in a direction parallel to the axis of the sleeve. Rotational movement of the sleeve is also prohibited. The sleeve tends to resist removal as a sample container T is withdrawn therefrom.

Figure 3B:
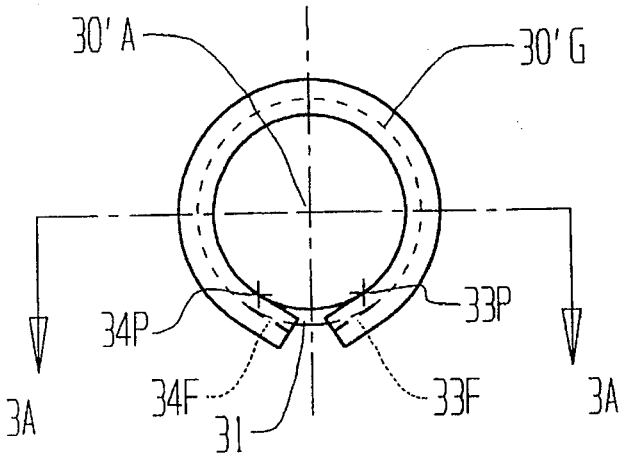
FIG. 3B is a plan view of the sleeve shown in FIG. 3A.
Figure 3A:
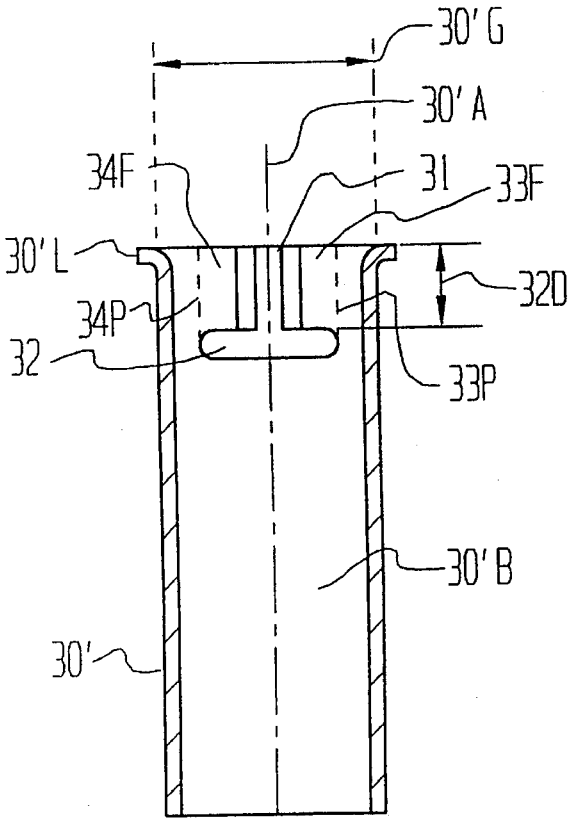
FIG. 3A is a side elevational view, substantially entirely in section, of a sleeve arranged for use in a shell-type rotor in accordance with a second, alternate, embodiment of the present invention.
Figure 3C:
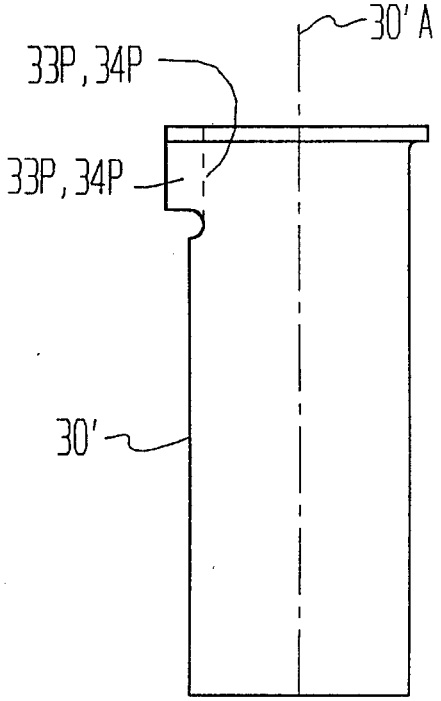
FIG. 3C is a side view of the sleeve shown in FIG. 3A.
Figure 3D:
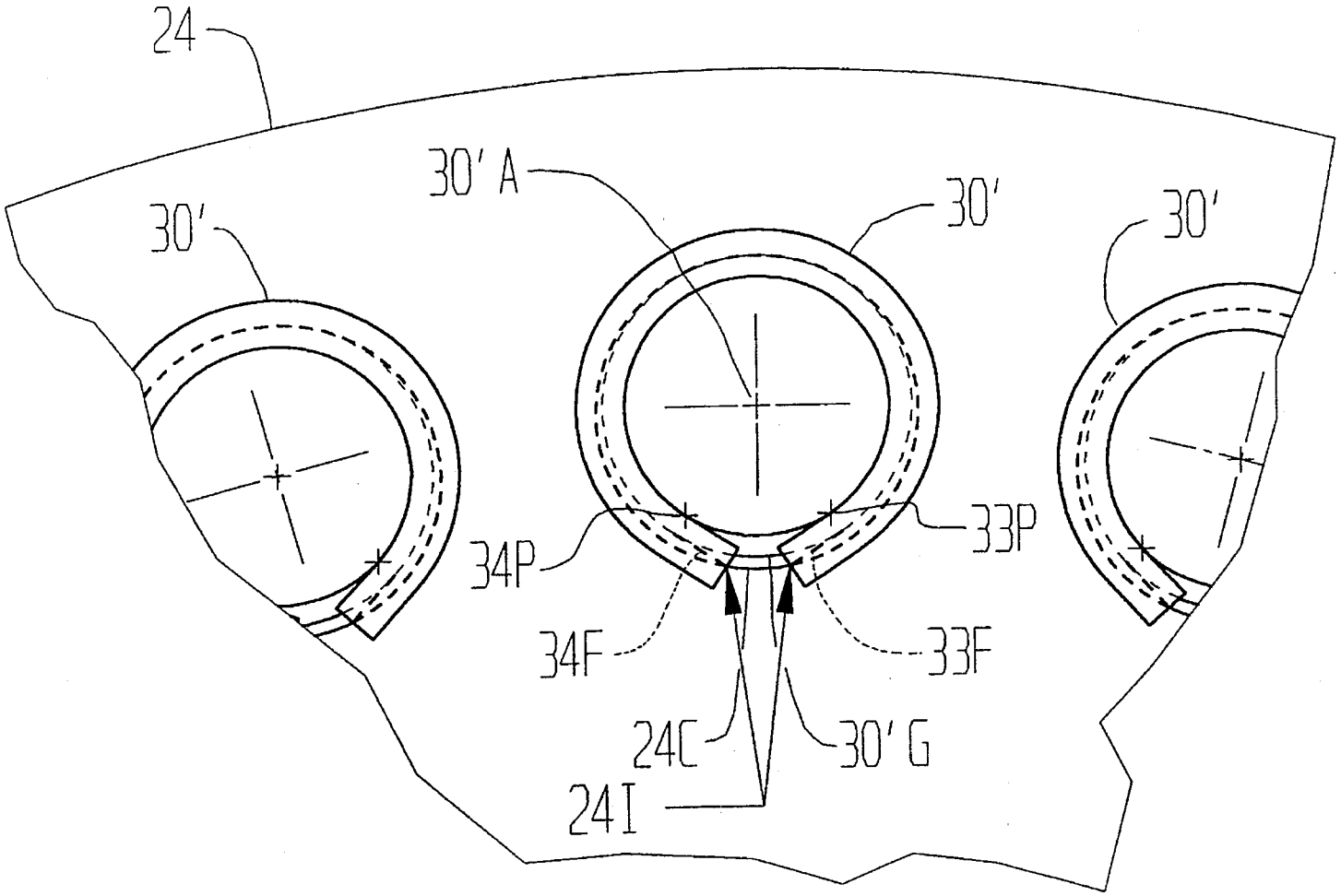
FIG. 3D is an enlarged plan view illustrating the sleeve shown in FIG. 3A received into the rotor plate of the shell-type rotor.

In accordance with a second embodiment of the invention the rotor 10 includes a sleeve 30' as shown in FIGS. 3A, 3B and 3C. The sleeve 30' again includes a circumferential lip 30'L and a hollow inner bore 30'B. However, in this embodiment the first slot 31 extends axially with respect to the sleeve axis 30'A from the open upper end thereof. The second slot 32 is a circumferentially extending slot that lies a predetermined distance 32D from the open upper end of the sleeve 30'. The distance 32D is at least equal to the thickness dimension 24D of the plate 24. The axial slot 31 and the circumferential slot 32 form a pair of resilient flanges 33F and 34F. The flanges 33F, 34F are each pivotally deflectable about a respective pivot axis 33P, 34P from a first, open, position (FIGS. 3A–3C) to a second, holding, position (FIG. 3D). The pivot axes 33P, 34P extends generally parallel to the axis 30'A of the sleeve 30'.

In the first, open, position (FIGS. 3A through 3C) the ends 33E, 34E of the flanges 33F,34F lie outside the basic outside dimension 30'G of the sleeve 30'. In the second, holding, position (FIG. 3D) each flange 33F, 34F abuts against the plate 24 in the vicinity of the cavity 24C therethrough. The cavity 24C in the plate 24 is sized to receive closely a sleeve 30' having the basic diameter 30'G. Again, since the ends 33E, 34E of the respective flanges 33F, 34F lie outside the basic diameter 30'G, the flanges 33F, 34F are displaced from the open position toward the closed position as the sleeve 30' is slidably inserted into the cavity 24C in plate 24. The axially insertion of the sleeve 30' causes each flange 33F and 34F to pivot about its respective pivot axis 33P and 34P. The pivotal motion of the flanges 33P, 34P is indicated by the arrows 33R, 34R (FIG. 3D). After the sleeve 30' is inserted into the cavity 24C in the plate 24, the resiliency of the flanges and the flanges 33F and 34F causes them to exert pressure against the plate 24 along holding interfaces 24I in the vicinity of the cavity 24C. The pressure exerted by the flanges 33F and 34F on the plate 24 causes the sleeve 30 to frictionally engage the plate 24, holding the sleeve 30 in an axially fixed relationship thereto.

Figure 4B:
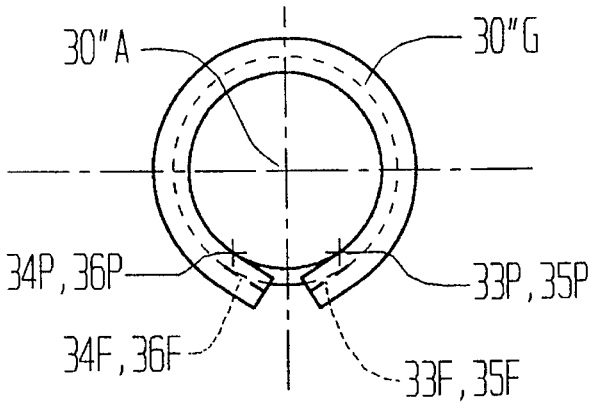
FIG. 4B is a plan view of the sleeve shown in FIG. 4A.
Figure 4A:
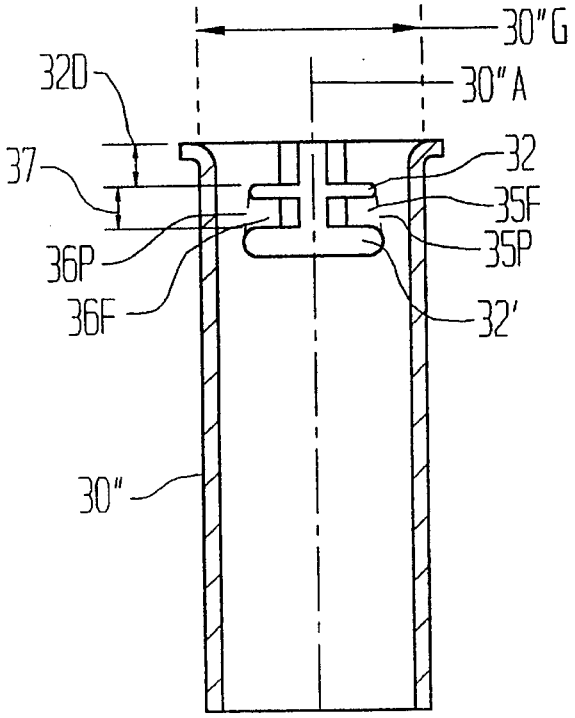
FIG. 4A is a side elevational view, substantially entirely in section, of a sleeve arranged for use in a shell-type rotor in accordance with a modification of the alternate embodiment of the present invention.
Figure 4C:
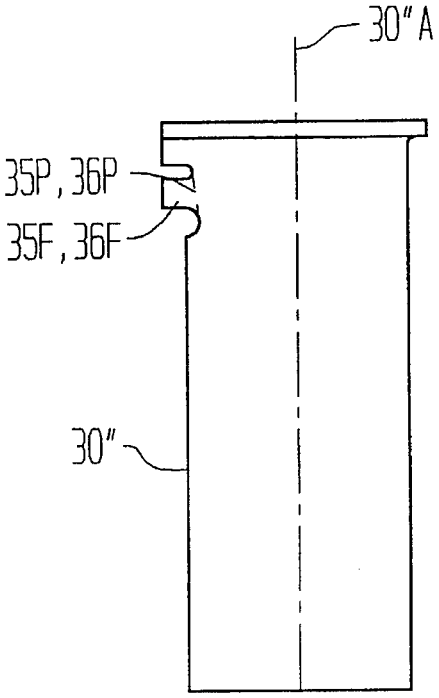
FIG. 4C is a side view of the sleeve shown in FIG. 4A.
Figure 4D:
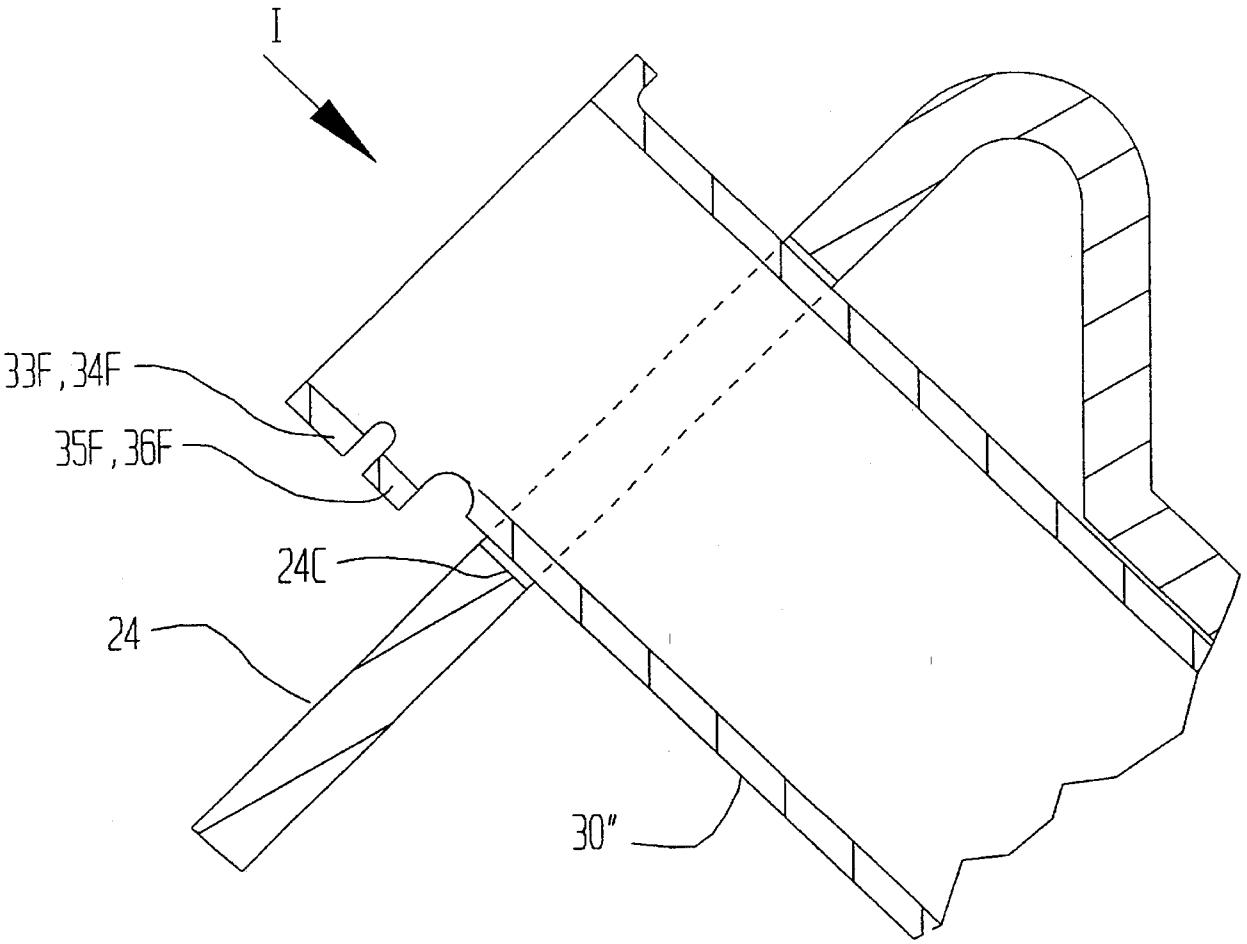
FIGS. 4D through 4F are enlarged side elevational views illustrating the insertion of the sleeve shown in FIG. 4A into the rotor plate of the shell-type rotor.

FIGS. 4A through 4D illustrates a modification of the second embodiment of the invention. In accordance with the modified embodiment the sleeve 30" has a second circumferential slot 32' spaced a predetermined distance 37 below the first circumferential slot 32. The axial slot 31, the first circumferential slot 32 and the second circumferential slot 32' define a second pair of flanges 35F and 36F. The flanges 35F, 36F are also each pivotally deflectable about a respective pivot axis 35P, 35P from a first, open, position (FIGS. 4A–4C) to a second, holding, position (FIG. 4D). The pivot axes 35P, 36P extend generally parallel to the axis 30"A of the sleeve 30". The pivot axes 35P, 36P may collinearly align with the pivot axis 33P, 34P for the flanges 33F, 34F, respectively, if desired. As can be seen in FIGS. 4B and 4C, in the open position both pairs of resilient flanges 33F, 34F and 35F, 36F lie outside of the basic diameter 30"G of the sleeve 30".

Figure 4E:
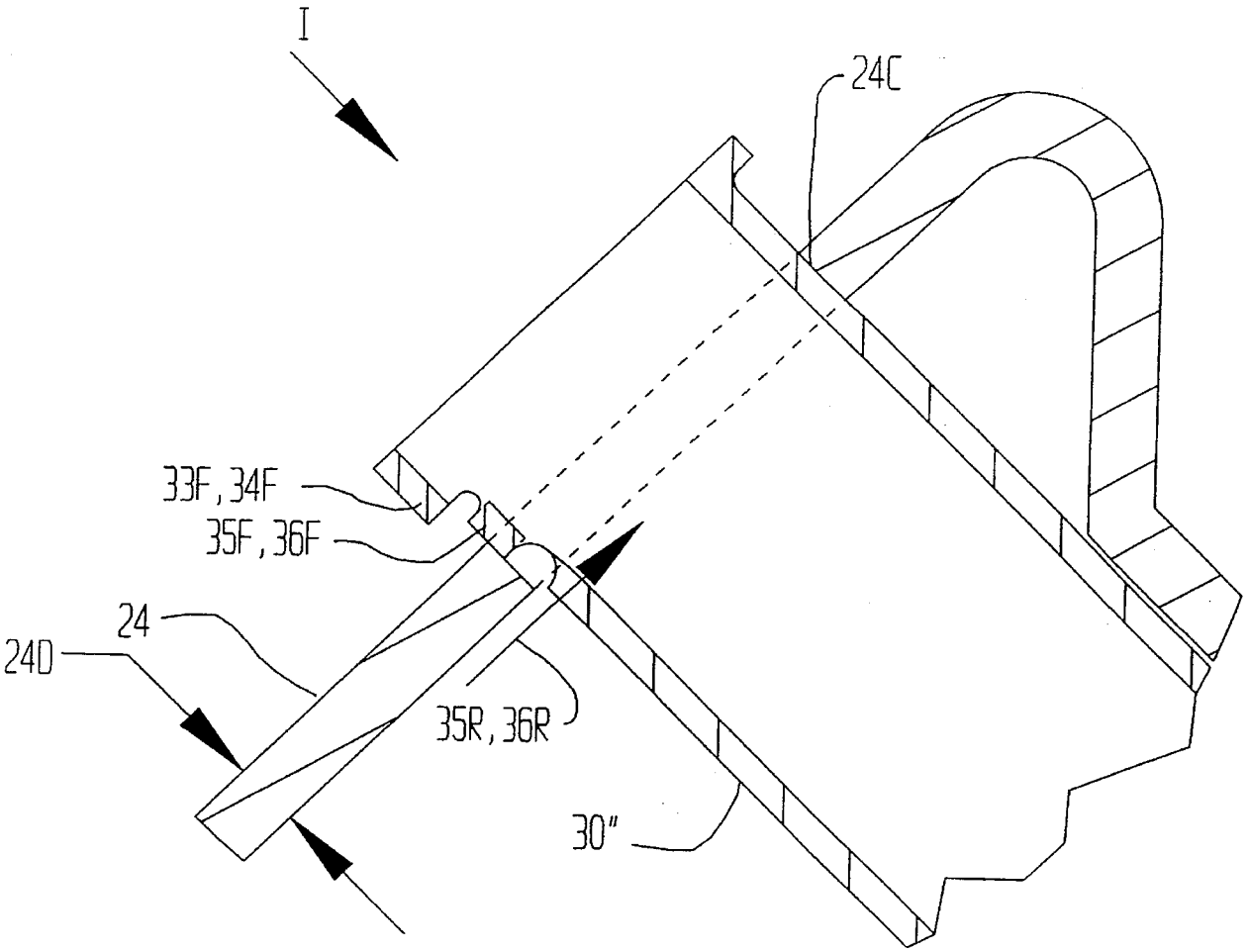

Since the cavity 24C in the plate 24 is sized to receive closely the basic diameter 30"G, and since both pair of flanges 33F, 34F and 35F, 36F lie outside this basic diameter 30"G, the paired flanges must again be retracted as the sleeve 30" is slidably inserted into the cavity 24C in the plate 24. As the sleeve 30" is axially inserted into the cavity 24C from the disposition shown in FIG. 4D (in the direction of arrow I), the flanges 35F and 36F in the second (lower) pair are first caused to pivot in the direction 35R, 36R about in the respective pivot axes 35P and 36P (FIG. 4E). Once the sleeve 30" is inserted into the cavity 24C in the plate 24 a sufficient axial distance to clear the thickness dimension 24D of the plate 24 the second pair of flanges 35F, 36F are released from contact against the plate 24.

Figure 4F:
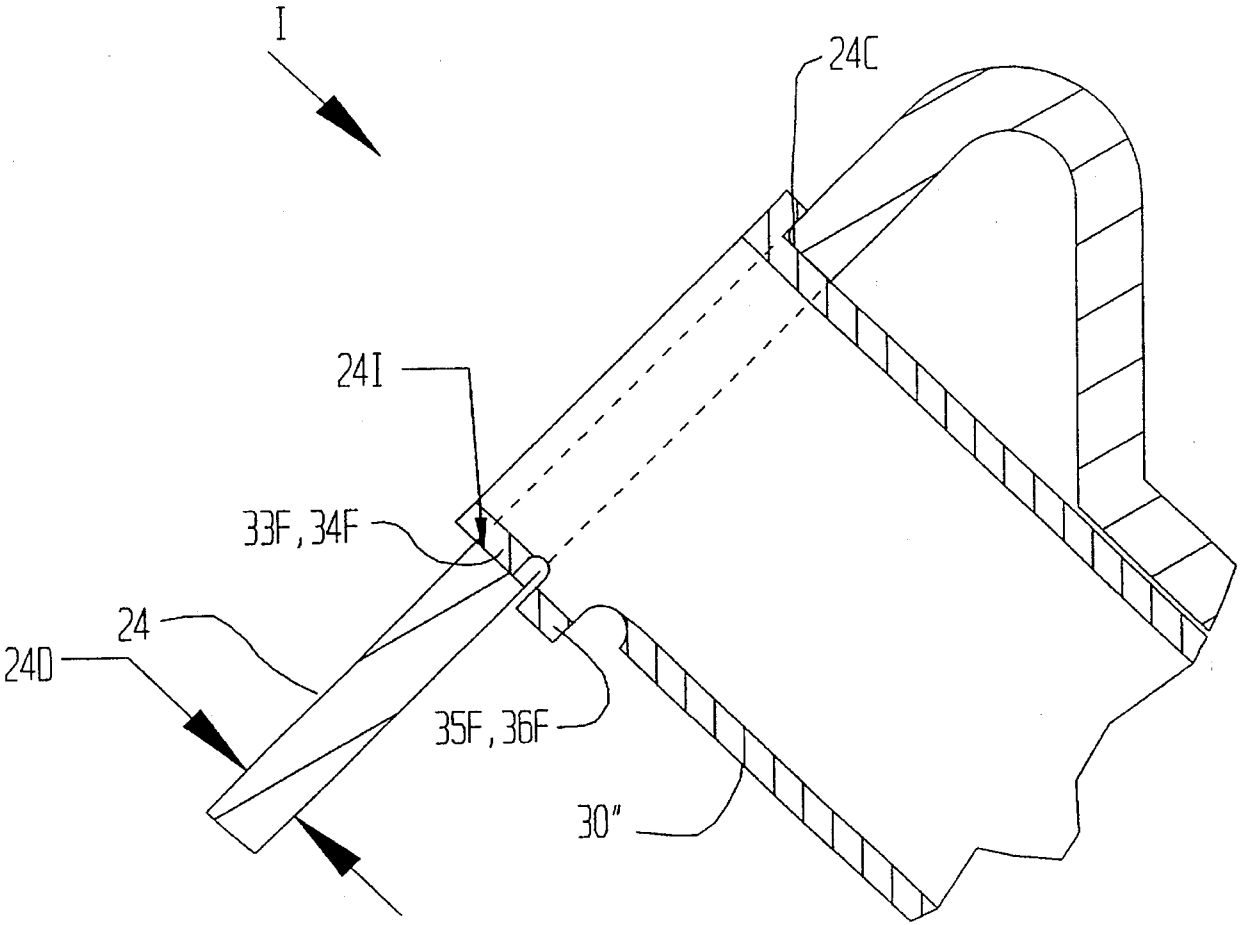

Once released the resiliency of the flanges 35F and 36F permits them to return to their open position, whereby the upper lateral edges of the flanges 35F, 36F contact against the undersurface 24U of the plate 24 (FIG. 4F). Continued axial insertion of the sleeve 30" into the cavity 24C then causes the flanges 33F and 34F to pivot about their respective pivot axis 33P and 34P toward their retracted position. However, the upper pair of flanges 33F, 34F are held by the material of the plate 24 in their retracted position. The resiliency of these flanges 33F and 34F exerts a holding pressure along a holding interface 24I against the material of the plate 24 in the vicinity of the cavity 24C. Thus, as is shown in FIG. 4F, the second (lower) pair of flanges 35A and 35B lie below the undersurface 24U to lock the sleeve 30" axially in place, while the pressure exerted by the flanges 33F and 34F on the plate 24 causes the sleeve 30 to frictionally engage the plate 24 holding the sleeve 30 in an axially fixed relationship thereto.

Those skilled in the art, having the benefit of the teachings of the present invention as hereinbefore set forth, may effect numerous modifications thereto. Such modifications are to be construed as lying within the contemplation of the present invention, as defined by the appended claims.

What is claimed is:

1. In a shell-type centrifuge rotor having a plate having an upper surface and an undersurface thereon and having at least one cavity therethrough, a generally hollow, elongated sleeve having at least one open end, the sleeve being received within the cavity to define a receptacle in which a sample container is received and supported during centrifugation, the sleeve having a basic outside dimension, the improvement comprising:

at least two slots formed in the sleeve, the slots cooperating to define on the sleeve at least one resilient flange, the flange having an end thereon, the flange being pivotally deflectable about a pivot axis from an open position in which the end of the flange lies outside the basic outside dimension of the sleeve to a second, holding, position in which the flange abuts against the plate in the vicinity of the cavity therethrough, when in the second position the flange frictionally engages the plate to hold the sleeve in an axially fixed relationship with respect to the plate.

2. The rotor of claim 1 wherein the slots extend axially along the sleeve from the open end thereof in parallel relationship to each other and to the axis of the sleeve, and wherein the pivot axis of the flange extends circumferentially in a plane that is generally perpendicular to the axis of the sleeve.

3. The rotor of claim 1 wherein a first one of the slots extends axially along the sleeve from the open end thereof and a second one of the slots extends circumferentially along the sleeve, the first and the second slots intersecting each other to define a pair of resilient flanges, the pair of flanges including said at least one resilient flange, and wherein the pivot axis of each flange extends generally parallel to the axis of the sleeve, each flange in the pair of flanges being pivotally deflectable about its pivot axis from an open position in which the end of the flange lies outside the basic outside dimension of the sleeve to a second, holding, position in which the flange abuts against the plate in the vicinity of the cavity therethrough.

4. The rotor of claim 3 wherein the plate has a predetermined thickness dimension, and wherein the circumferential slot is disposed a distance from the open end of the sleeve that is at least equal to the thickness dimension of the plate.

5. The rotor of claim 3 further comprising a second circumferentially extending slot formed in the sleeve in generally parallel relationship to the first circumferentially extending slot, the second circumferentially extending slot being spaced from the open end of the sleeve a distance greater than the distance at which the first circumferential slot is spaced from the open end of the sleeve, the second circumferential slot cooperating with the axial slot and with the first circumferential slot to define a second pair of resilient flanges, each of the flanges in the second pair being pivotally deflectable about a pivot axis from an open position in which the end of the flange lies outside the basic dimension of the sleeve to a second, retracted, position, the pivot axis of each flange extending generally parallel to the axis of the sleeve, while in the open position the second pair of flanges abuts against the undersurface of the plate to prevent axial movement of the sleeve with respect to the plate.

6. The rotor of claim 5 wherein the plate has a predetermined thickness dimension, and wherein the first circumferential slot is disposed a distance from the open end of the sleeve that is at least equal to the thickness dimension of the plate.

* * * * *